US011199021B2

(12) United States Patent
Cox

(10) Patent No.: US 11,199,021 B2
(45) Date of Patent: Dec. 14, 2021

(54) TENT OR SHADE PROVIDING STRUCTURE

(71) Applicant: LSO, LP, San Diego, CA (US)

(72) Inventor: Brian Cox, San Diego, CA (US)

(73) Assignee: LSO, LP, San Diego, CA (US)

( * ) Notice: Subject to any disclaimer, the term of this patent is extended or adjusted under 35 U.S.C. 154(b) by 0 days.

(21) Appl. No.: 16/971,468

(22) PCT Filed: Feb. 13, 2019

(86) PCT No.: PCT/US2019/017759
§ 371 (c)(1),
(2) Date: Aug. 20, 2020

(87) PCT Pub. No.: WO2019/164714
PCT Pub. Date: Aug. 29, 2019

(65) Prior Publication Data

US 2020/0378147 A1 Dec. 3, 2020

Related U.S. Application Data

(60) Provisional application No. 62/634,294, filed on Feb. 23, 2018.

(51) Int. Cl.
*E04H 15/40* (2006.01)
*E04H 15/44* (2006.01)
(Continued)

(52) U.S. Cl.
CPC ..... *E04H 15/40* (2013.01); *E04H 15/005* (2013.01); *E04H 15/44* (2013.01); *E04H 15/54* (2013.01); *E04H 15/58* (2013.01); *E04H 15/60* (2013.01)

(58) Field of Classification Search
CPC ..... E04H 15/003; E04H 15/005; E04H 15/34; E04H 15/40; E04H 15/48; E04H 15/58; E04H 15/60; E04H 1/1244
See application file for complete search history.

(56) References Cited

U.S. PATENT DOCUMENTS 1,728,356 A * 9/1929 Morgan ..... E04H 15/50 135/154
3,810,482 A * 5/1974 Beavers ..... E04H 15/48 135/147

(Continued)

FOREIGN PATENT DOCUMENTS

CA 2745545 A1 * 1/2013 ..... E04H 15/34
DE 102004031779 A1 * 3/2005 ..... A45F 3/52

*Primary Examiner* — David R Dunn
*Assistant Examiner* — Danielle Jackson
(74) *Attorney, Agent, or Firm* — Norman E. Lehrer

(57) ABSTRACT

A tent (10) comprised of two panels (12, 14) are joined at their tops (16) but which have free lower ends resting on the ground. The tent (10) is maintained in its vertical position by a pair of elongated rods (22, 24) on the inside of each side panel that are arranged in an X configuration. The ends of the rods are positioned in pockets (26, 28, 30, 32, 34) provided in the interior of the four corners of each side panel and are somewhat rigid but capable of flexing outwardly to provide structural support for the side panels. Adjustment straps (40, 42, 44) along the vertical edges of the side panels are used to adjust the tension on the rods. In a second embodiment (110) only one side panel (112) is provided and a vertical pole (160, 162) is used to support the top of the panel. The slide panel (112) is also provided with crossbars in an X configuration. The vertical angle of the vertical support pole (160, 162) can be changed to adjust the height of the lean-to.

9 Claims, 2 Drawing Sheets

(51) Int. Cl.

| | |
|---|---|
| ***E04H 15/54*** | (2006.01) |
| ***E04H 15/60*** | (2006.01) |
| ***E04H 15/00*** | (2006.01) |
| ***E04H 15/58*** | (2006.01) |

(56) References Cited

U.S. PATENT DOCUMENTS 3,941,140 A * 3/1976 Beavers ..... E04H 15/32 135/147
4,026,312 A * 5/1977 Beavers ..... E04H 15/48 135/147
4,077,417 A * 3/1978 Beavers ..... E04H 15/48 135/121
4,202,065 A * 5/1980 Sullivan ..... A47D 9/005 5/99.1
4,941,499 A * 7/1990 Pelsue ..... E04H 15/42 135/125
5,573,028 A * 11/1996 van der Stigohel .... E04H 15/48 135/147
5,628,338 A * 5/1997 Stumbo ..... E04H 15/40 135/147
6,904,923 B2 * 6/2005 Chai ..... B60J 1/2011 135/21
7,958,904 B2 * 6/2011 Lau ..... A01M 31/025 135/147
8,087,423 B2 * 1/2012 Knipschild ..... E04H 15/40 135/125
9,120,620 B2 * 9/2015 Warren ..... B65F 1/1415
9,598,876 B1 * 3/2017 LaHood ..... E04H 15/58
9,752,345 B1 * 9/2017 LaHood ..... E04H 15/30
10,149,530 B1 * 12/2018 Grayson ..... E04H 15/30
10,563,423 B1 * 2/2020 Bird ..... E04H 15/46
10,767,387 B2 * 9/2020 Bird ..... E04H 15/44
2002/0020439 A1 * 2/2002 Tate ..... E04H 15/425 135/124
2008/0083443 A1 * 4/2008 Eastman, II ..... E04H 15/44 135/121
2009/0084420 A1 * 4/2009 Pelsue ..... E04H 15/48 135/96
2017/0096833 A1 * 4/2017 Colbeck ..... E04H 15/54
2018/0066446 A1 * 3/2018 Nolz ..... E04H 15/48
2019/0352925 A1 * 11/2019 Pearson ..... E04H 15/642

* cited by examiner

TENT OR SHADE PROVIDING STRUCTURE

TECHNICAL FIELD

The present invention is directed toward a tent or similar shade providing arrangement such as a lean-to or the like. The tent requires no vertical support poles or external support and the height of the same can easily be adjusted.

BACKGROUND ART

Lightweight tents made of nylon or other fabric have, of course, been around for many years. The majority of these, however, are somewhat complex utilizing numerous poles, ropes and other component parts to maintain the same in an erect position. Many are also designed for quick erection or automatic opening. These tents, however, require somewhat complex mechanisms and interaction of parts to function properly.

Tents that require center vertical poles or external poles for maintaining them in their erect condition have only one height and the height is not adjustable. Furthermore, such tents can be somewhat bulky to handle and/or require multiple separate parts that must be carried.

Simple two-panel tents are available wherein the height can be adjusted. These are essentially comprised of two side panels attached at the top with the bottom edges of the side panels secured to the ground. However, these "pup tents" are supported by ropes at the front and the back that must be attached to adjacent trees or other support structures. They are not self-supporting.

There is, therefore, a need for a self-supporting tent or similar shade providing structure that is self-supporting and wherein the height of the same can be easily adjusted.

SUMMARY OF THE INVENTION

The present invention overcomes the deficiencies of the prior art described above. The invention includes a tent comprised of two panels that are joined at their tops but which have free lower ends that are adapted to rest on the ground. The tent is maintained in its vertical position by a pair of elongated rods on the inside of each side panel that are arranged in an X configuration. The ends of the rods are positioned in pockets provided in the interior of the four corners of each side panel and are somewhat rigid but capable of flexing outwardly to provide structural support for the side panels. Adjustment straps along the vertical edges of the side panels are used to adjust the tension on the rods.

In a second embodiment of the invention, only one side panel is provided and a vertical pole is used to support the top of the panel. The side panel is still provided with the crossbars in an X configuration. Furthermore, the vertical angle of the vertical support pole can be changed to adjust the height of the lean-to.

DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
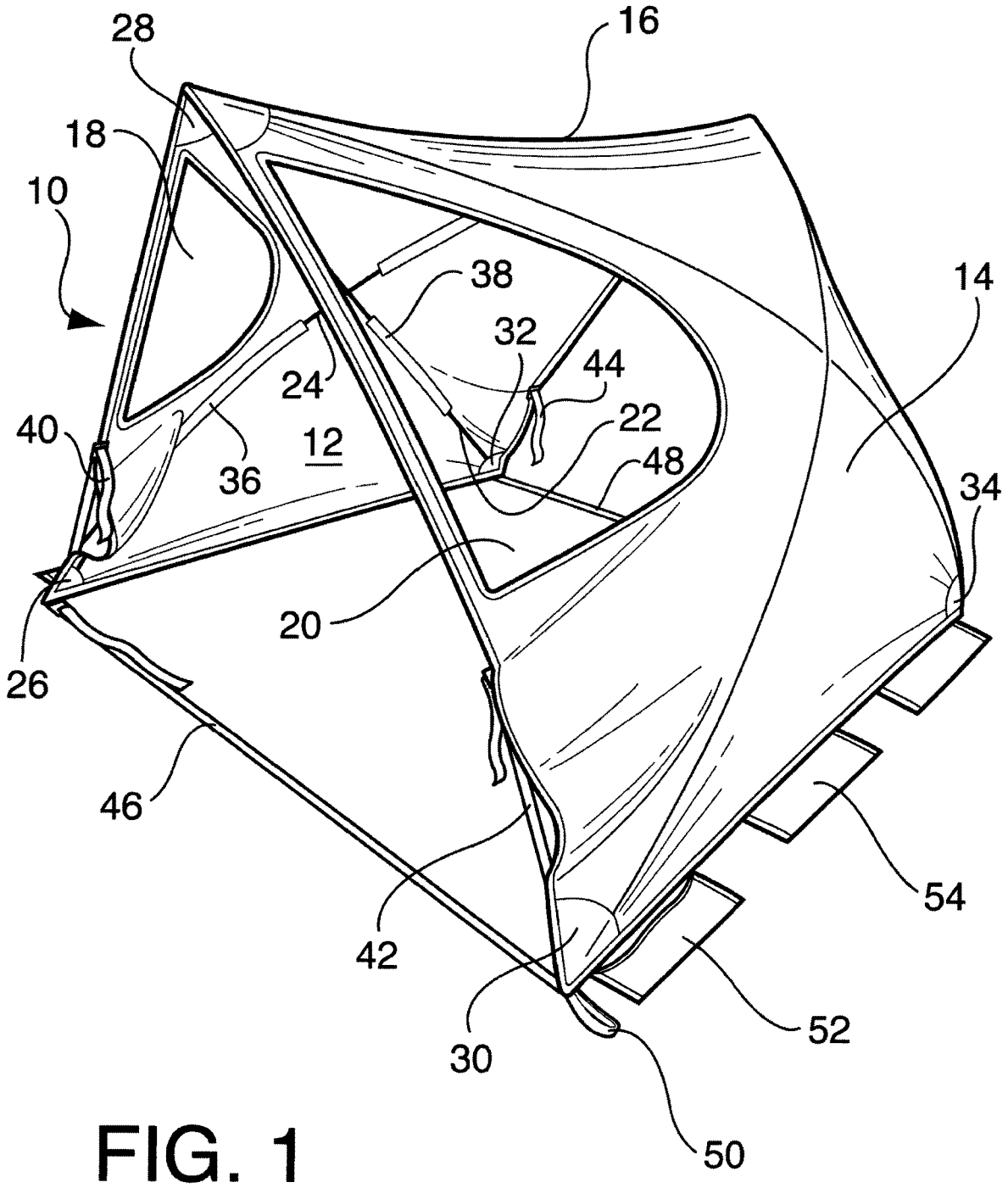
FIG. 1 is a perspective view of a tent or shade providing structure of the invention.

Referring now to FIG. 1, there is shown therein a perspective view of a tent or shade providing arrangement constructed in accordance with the principles of the present invention designated generally at 10. The tent 10 includes essentially a pair of side panels 12 and 14. The side panels are joined at the top 16 thereof. In the preferred embodiment, there is essentially one substantially rectangular piece of cloth or other fabric material which may be nylon or substantially any other tent material which is simply folded at its center to create the two side panels 12 and 14.

As with any tent or similar structure, the side panels 12 and 14 may include windows such as shown at 18 and 20 which may be open or include a transparent or translucent material integral therewith. Similarly, there could be additional flaps of material that can be used to cover the openings 18 and 20 with zippered connectors or ties or the like.

The side panels 12 and 14 are maintained in their erect position through the use of crossed elongated rods such as shown at 22 and 24 on panel 12. It will be understood that substantially identical rods are also on the interior surface of the panel 14. The rods 22 and 24 are substantially rigid but can be flexed somewhat in order to provide tension on the panels 12 and 14. The rods can be made of plastic or fiberglass or spring steel or substantially any other material which can function in the desired manner.

The ends of each of the rods are maintained in pockets such as shown at 26, 28, 30, 32 and 34. While not specifically shown, there are similar pockets in each of the four corners of each of the interiors of side panels 12 and 14.

While not absolutely necessary, the interior of each of the side panels may also include sleeves such as shown at 36 and 38 to maintain the poles 22 and 24 in proper alignment. The amount of flexing of the rods 22 and 24 can be adjusted utilizing the straps and buckles shown as at 40, 42 and 44 at the bottom of the front and back edges of each of the panels 12 and 14.

When assembling the structure 10, the straps 40-44 are released or loosened to make it easy to insert the rods 22, 24, etc. in the proper position with the ends in the pockets. Preferably, the rods are slightly longer than the diagonal of the side panels so that, when first assembled, the side panels are flexed slightly outwardly. They can then be further flexed utilizing the straps. As can clearly be seen in the drawings, a different one of the straps 40-44 is located at and in alignment with each of the front and rear vertical edges of each of the side panels. As a result, for example, by tightening or loosening the strap 40, the effective length of the front side edge of the panel 12 can be adjusted as the pockets 26 and 28 are either drawn toward each other or moved away from each other. This puts more or less tension on the rods 22 and 24. It is, of course, understood that the straps on the other front and rear vertical edges can operate in the same manner.

The height of the structure 10 can be adjusted simply by moving the bottoms of the panels 12 and 14 toward or away from each other. Once in the desired position, the adjustable straps 46 and 48 at the front and rear of the structure are secured in place so that further outward movement of the bottoms of the panels 12 and 14 are prevented.

The tent 10 can simply rest on the ground or can be secured thereto utilizing tent stakes through loops such as shown at 50 that are arranged at the four corners or at any other position at the bottom edges of the side panels 12 and 14. Alternatively, and for particular use on a beach or the like, the bottom edges of the side panels 12 and 14 can be provided with flaps 52 and 54 which can also include a pocket into which sand can be placed to weight the tent down.

Figure 2:
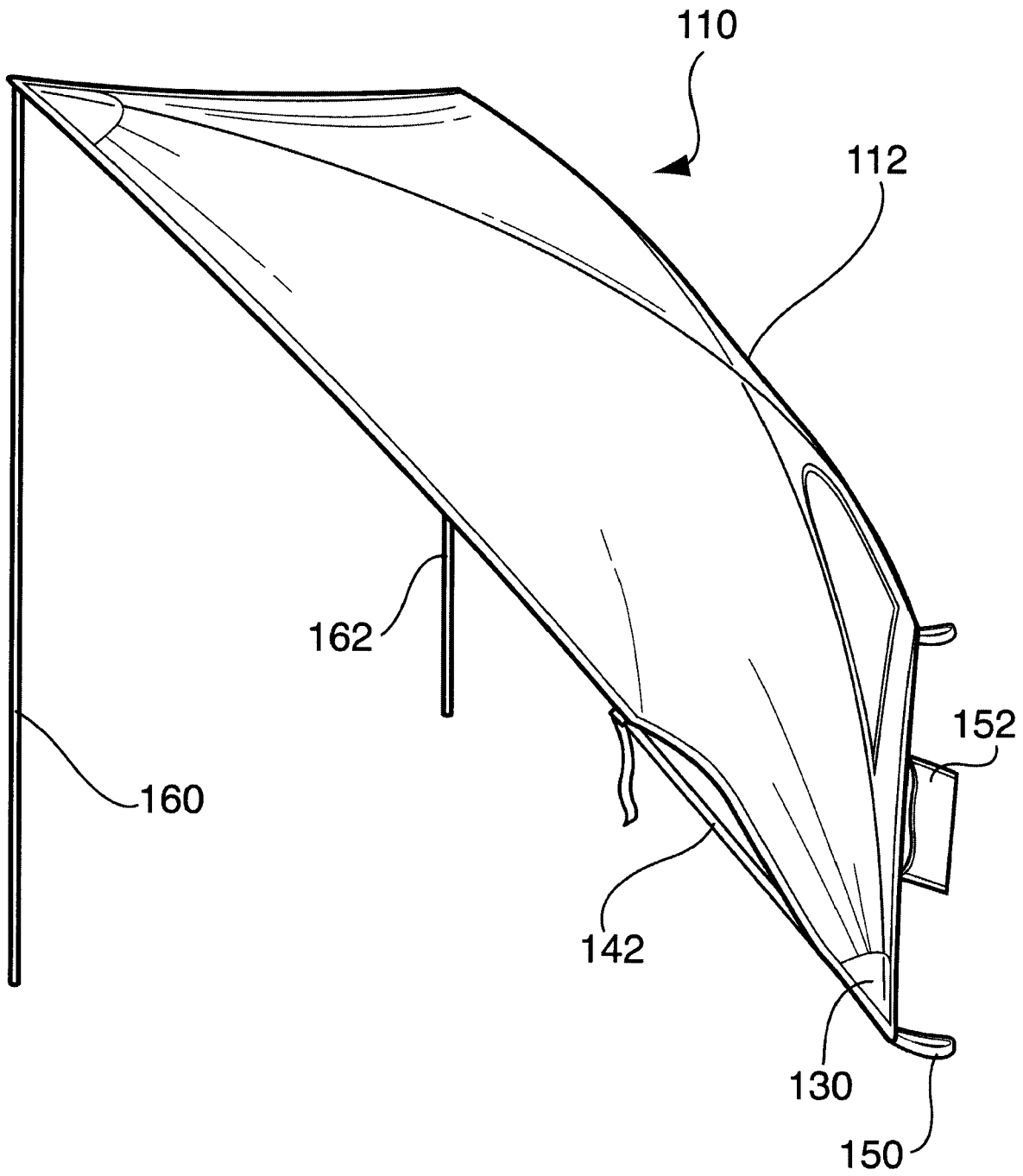
FIG. 2 is a perspective view of a lean-to shade arrangement according to a second embodiment of the invention.

FIG. 2 shows a second embodiment of the invention which is more in the form of a lean-to or the like and designated generally as 110. The structure shown in FIG. 2 includes only a single panel 112 which also includes the internal rods (not shown) that are substantially the same as the rods shown in FIG. 1. The ends are maintained in pockets such as shown at 130 and the tension on the rods is adjusted utilizing the adjustable straps 142 at the bottom of each side.

The embodiment shown in FIG. 2, however, does require a pair of substantially vertical support bars 160 and 162. The height of the structure shown in 110 can be adjusted by adjusting the vertical angle of the support bars 160 and 162 by moving the bottoms closer to or away from the bottom edge of the panel 112. In order to prevent movement of the bottom edge of the panel 112, tent stakes can be provided in the loops 150 and/or flaps with pockets such as shown at 152 can be covered with or filled with sand.

The present invention may be embodied in other specific forms without departing from the spirit or essential attributes thereof and accordingly, reference should be made to the appended claims rather than to the foregoing specification as indicating the scope of the invention.

The invention claimed is:

1. A side panel for a tent structure comprised of:

a substantially rectangularly shaped piece of cloth material or other flexible fabric material having an interior surface and an exterior surface;

said material having a top edge, a bottom edge, a front vertical edge and a rear vertical edge, a first corner formed between said bottom edge and said front edge, a second corner formed between said front edge and said top edge, a third corner formed between said top edge and said rear edge and a fourth corner formed between said rear edge and said bottom edge;

first, second, third and fourth pockets located on said interior surface at said first, second, third and fourth corners, respectively;

first and second elongated rods, said rods being substantially rigid but able to be somewhat flexed, each of said rods having ends;

the ends of said first rod being positioned in said first and third pockets and the ends of said second rod being positioned in said second and fourth pockets;

the length of said rods being longer than the distance between the pockets in which they are positioned so as to flex said material outwardly, and cooperating straps and buckles attached to said front and rear vertical edges in order to adjust the tension on said rods, said straps and buckles being located at and in alignment with their respective front and rear vertical edges, whereby, by tightening or loosening the straps, the effective length of the front and rear vertical edges can be adjusted.

2. The side panel as claimed in claim 1 further including means located on said interior surface for retaining said rods in proper alignment.

3. The side panel as claimed in claim 2 wherein said means for retaining includes a plurality of sleeves secured to said interior and surrounding said rods.

4. The side panel as claimed in claim 1 further including a pair of vertical poles extending between said top edge and the ground.

5. The side panel as claimed in claim 4 further including means for retaining said bottom edge on said ground.

6. A tent structure comprised of:

first and second side panels, each of said side panels including a substantially rectangularly shaped piece of cloth material or other flexible fabric material having an interior surface and an exterior surface;

said material of each panel having a top edge, a bottom edge, a front vertical edge and a rear vertical edge, a first corner formed between said bottom edge and said front edge, a second corner formed between said front edge and said top edge, a third corner formed between said top edge and said rear edge and a fourth corner formed between said rear edge and said bottom edge, the top edges of said first and second panels being connected to each other and the bottom edges of said first and second panels being spaced from each other;

each of said panels including first, second, third and fourth pockets located on said interior surface at said first, second, third and fourth corners, respectively;

first and second elongated rods associated with each panel, said rods being substantially rigid but able to be somewhat flexed, each of said rods having ends;

the ends of one of said first rods being positioned in said first and third pockets of one of said panels, the ends of the other of said first rods being positioned in said first and third pockets of the other of said panels, the ends of one of said second rods being positioned in said second and fourth pockets of said one of said panels and the ends of the other of said second rods being positioned in said second and fourth pockets of said other of said panels;

the length of said rods being longer than the distance between the pockets in which they are positioned so as to flex said material outwardly, and cooperating straps and buckles attached to each of said front and rear vertical edges in order to adjust the tension on said rods, said straps and buckles being located at and in alignment with their respective front and rear vertical edges, whereby, by tightening or loosening the straps, the effective length of the front and rear vertical edges can be adjusted.

7. The tent structure as claimed in claim 6 further including means located on said interior surface for retaining said rods in proper alignment.

8. The structure as claimed in claim 7 wherein said means for retaining includes a plurality of sleeves secured to said interior and surrounding said rods.

9. The tent structure as claimed in claim 6 further including means for adjusting the distance between said bottom edges of said first and second panels.

* * * * *